United States Patent [19]

Liu

[11] 4,295,302

[45] Oct. 20, 1981

[54] INFLATABLE TENT

[76] Inventor: Morris Liu, 5, Alley 21, Lane 172, Sec. 1 Keelung Rd., Taipei, Taiwan

[21] Appl. No.: 82,941

[22] Filed: Oct. 9, 1979

[30] Foreign Application Priority Data

Aug. 21, 1979 [TW] Taiwan ..... 6823010

[51] Int. Cl.[3] ..... E04B 1/345

[52] U.S. Cl. ..... 52/2

[58] Field of Search ..... 52/2; 9/11 A, 11 R

[56] References Cited

U.S. PATENT DOCUMENTS 2,946,337 7/1960 Wolshin ..... 52/2
3,457,684 7/1969 Wood ..... 52/2

FOREIGN PATENT DOCUMENTS 635028 7/1962 Canada ..... 52/2
450647 10/1917 Fed. Rep. of Germany ..... 9/11 A
821439 10/1959 United Kingdom ..... 52/2
887940 1/1962 United Kingdom ..... 9/11 A

*Primary Examiner*—James L. Ridgill, Jr.
*Attorney, Agent, or Firm*—Oldham, Oldham, Hudak & Weber

[57] ABSTRACT

An inflatable tent is disclosed wherein the tent comprises a plurality of inflatable frames for supporting the tent; an air passage tube for interconnecting the frames and permitting air to flow therein; a plurality of blockage mechanisms installed on the air passage tube for partitioning the air system in the tent into several independent parts; a water-proof film integrally formed with the frames and the tube for filling the gaps therebetween; an inlet and an outlet for receiving and releasing air respectively; and a plurality of handles for easy set up of the tent under various environments.

4 Claims, 8 Drawing Figures

INFLATABLE TENT

BACKGROUND OF THE INVENTION

This invention generally relates to a novel tent structure, and more particularly to an inflatable tent that is portable and can be readily set up on the ground, hung on a tree, or floating on water.

Conventional tents are made of canvas and supporting poles. The disadvantages are that they are not easily portable, not generally applicable to many different environments or ground conditions, and cannot be easily assembled.

SUMMARY OF THE INVENTION

One object of the present invention is to provide a tent that is generally useable under various environments or ground conditions.

Another object of the present invention is to provide a tent that is portable and easily inflatable through an inflator which can be hand or foot operated.

Still another object of the present invention is to provide an inflatable tent wherein the air system is partitioned into several isolated parts so that leakage in one part has no effect on the others and therefore will not cause the tent to collapse.

Still another object of the present invention is to provide an inflatable tent wherein multi-layer structure is provided for the constituent parts thereof to meet strength and floating requirements.

DETAILED DESCRIPTION OF THE PREFERRED EMBODIMENT

Figure 1:
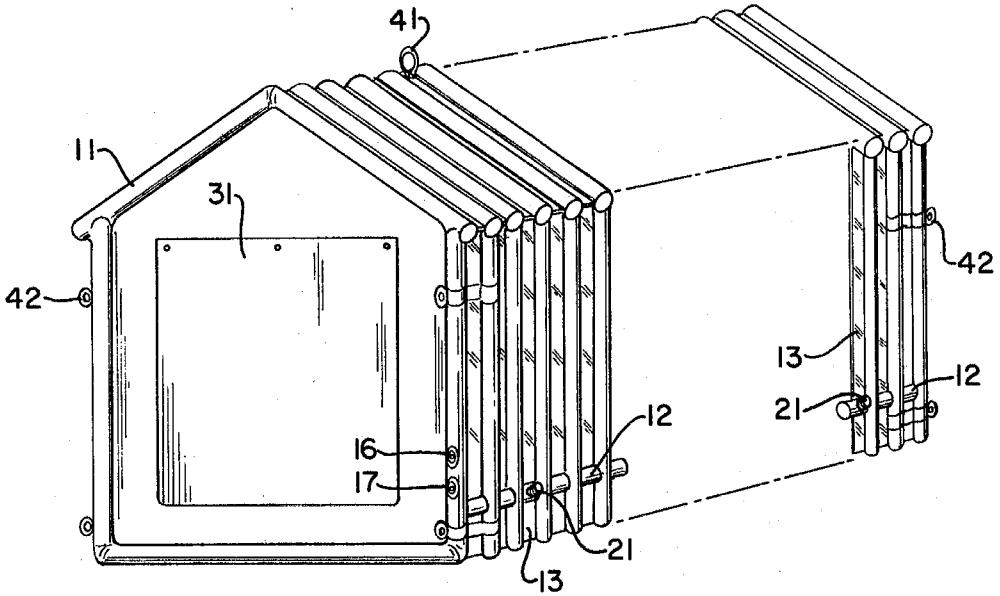
FIG. 1 is a perspective view of the inflatable tent according to the present invention.

The inflatable tent of the present invention is detailed below with reference to the accompanying drawings. As shown in FIG. 1, the tent according to the present invention substantially comprises a plurality of inflatable frames 11 for supporting the tent; an air passage tube 12 for transmitting air to the inflatable portions of the tent; a plurality of blockage studs 21 for isolating the frames from each other; two side doors 31; and a plurality of handles 41, 42 for setting up the tent on the ground, on a tree, or on water.

Figure 3:
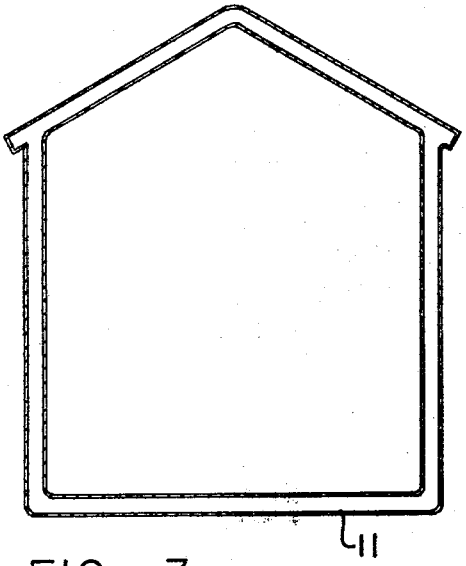
FIG. 3 is a cross-sectional view of the frame of the inflatable tent.
Figure 4:
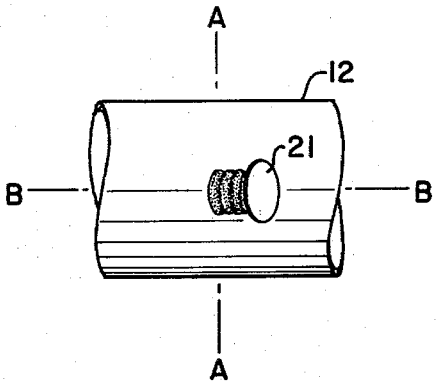
FIG. 4 is a perspective view illustrating the installation of a blockage stud on the air passage tube of the inflatable tent.
Figure 5:
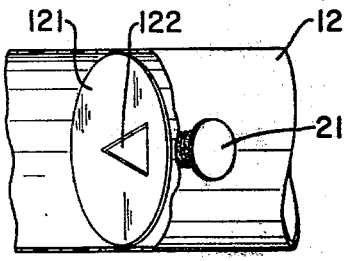
FIG. 5 is a sectional view showing the blocking mechanism which partitions the air system inside the tent into several isolated parts.

The frames 11 are made of hollow tubes and interconnected with the air passage tube 12. A frame is further illustrated in FIG. 3 for clarity. Air can be pumped in from an inlet 16 or discharged through an outlet 17 to inflate or deflate the tent respectively. A layer of plastic film 13 is integrally formed with the frames 11 and the air passage tube 12 so that no gap exists between the frames 11 or between the frames 11 and the tube 12.

Figure 2:
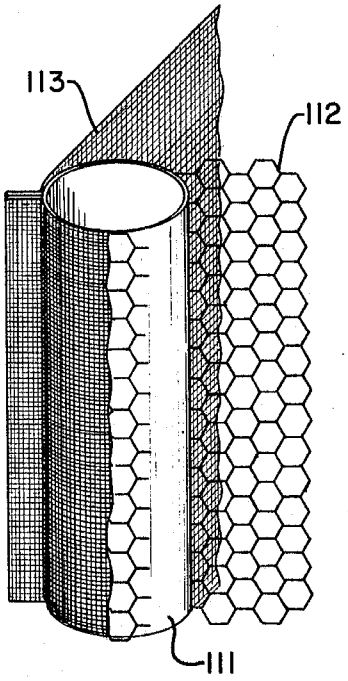
FIG. 2 is a perspective view showing the multi-layer structure of the constituent parts of the tent.

Refer to FIG. 2, in order to ensure the steadiness of the inflated tent and meet various tension of floating requirements, the frames 11, the air passage tube 12, and the plastic film 13 have a multi-layer structure. They comprise an inner layer of soft plastic material 111, a central layer of nylon or any non-metallic netting 112, and an outer layer of nylon cloth or any other durable and water-proof materials 113.

Figure 6:
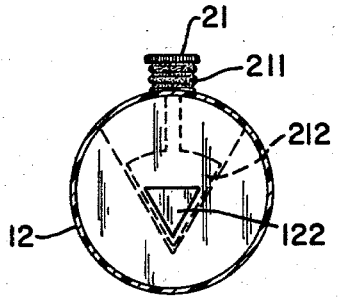
FIG. 6 is a perspective view showing the position of the stud inside the air passage tube when the stud is in its blocked position.
Figure 7:
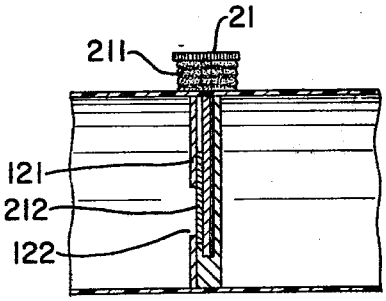
FIG. 7 is a sectional view taken along line B—B in FIG. 4 when the stud is in its blocked position.
Figure 8:
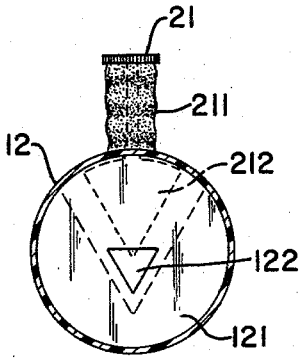
FIG. 8 is a perspective view showing the position of the stud inside the air passage tube when the stud is in its released position.

According to the present invention, a plurality of blockage studs 21 are adopted to partition the air system inside the inflatable tent into several independent parts so that a few leakages in the tent will not cause the entire tent to shrink or collapse. Refer to FIGS. 4 through 8, the studs 21 are installed on the air passage tube 12 with an inverted cone portion 212 for blocking the air flow in the tube 12 and a head 210 of the stud being outside the tube. A blockage layer 121 which cooperates with the inverted cone portion 212 is formed on the tube 12 with a triangle-shaped air opening 122 provided thereon. When the stud 21 is pressed down from outside, as shown in FIGS. 6 and 7, to assume its blocked position, the opening 122 is closed by the inverted cone portion 212 of the stud 21 so that no air is permitted to flow through the opening 122. On the other hand, when the tent is to be inflated or deflated, the studs 21 are pulled up as shown in FIG. 8 to displace the inverted cone portions 212 from the opening 122. A connected air system is then established in the inflatable tent. A rubber seal 211 is further provided between the stud 21 and the air passage tube 12 to ensure airtightness when the stud 21 is being pushed or pulled.

It should be noticed that if there is any leakage occurred on the tent, the air pressure in the tube 12 on one side of the inverted cone portion 212 in FIG. 7 will be greatly reduced, and the pressure on the other side of the tube 12 will force the inverted cone portion 212 to abut against the blockage layer 121, which further prevents the other parts of the tent from being affected by the leakage.

The tent according to the present invention is easily portable, and can be readily built on the ground, hung on a tree, or even floating on water serving as a ferry, a fishing boat, or a life boat.

Although the present invention has been described hereinbefore with a preferred embodiment, it is to be understood that minor changes or modifications are still possible without departing from the spirit and scope of the present invention.

What is claimed is:

1. An inflatable tent substantially comprising a plurality of inflatable frames for supporting the tent; an air passage tube for interconnecting the frames and permitting air to flow therein; a plurality of blockage studs installed on the air passage tube for partitioning the air system inside the tent into several isolated parts; a waterproof layer of plastic film integrally formed with the frames and the air passage tube for filling the gaps between the frames and between the frames and the air passage tube; the frames, the air passage tube, and the plastic film are multi-layer structured and all comprise an inner layer of soft plastic film and an outer layer of reinforcing netted plastic material; and inlet and an outlet for receiving or releasing air respectively; and a plurality of handles for easy set up of the tent.

2. The inflatable tent according to claim 1, wherein the blockage stud comprises an inner blockage portion which, when the stud is at its blocked position, closes an opening on a blockage layer formed in the air passage tube, thereby to prevent air flow through the air passage tube, said stud having a head external of said air passage tube and being movable radially in relation to the tube to move from air passage to blockage position, a seal being provided between said stud and said air passage tube.

3. The inflatable tent, according to claim 1, wherein yet a third and outer layer made of non-metallic netting is provided on at least portions of the frames, the air passage tube and the plastic film to strengthen the same.

4. The inflatable tent, according to claim 1 or 2, said tent having top and end portions, and where a plurality of handles are attached to said top and end portions of the tent to facilitate handling the tent.

* * * * *